US007591582B2

(12) United States Patent
Hiranuma et al.

(10) Patent No.: US 7,591,582 B2
(45) Date of Patent: Sep. 22, 2009

(54) WATCH AND CROWN USED IN THIS WATCH

(75) Inventors: Haruki Hiranuma, Chiba (JP); Nobukazu Omori, Chiba (JP)

(73) Assignee: Seiko Instruments Inc. (JP)

( * ) Notice: Subject to any disclaimer, the term of this patent is extended or adjusted under 35 U.S.C. 154(b) by 298 days.

(21) Appl. No.: 11/353,469

(22) Filed: Feb. 14, 2006

(65) Prior Publication Data

US 2006/0187766 A1 Aug. 24, 2006

(30) Foreign Application Priority Data

Feb. 21, 2005 (JP) ..... 2005-043336

(51) Int. Cl.
*G04B 29/00* (2006.01)

(52) U.S. Cl. ..... 368/308; 368/319

(58) Field of Classification Search ..... 368/190, 368/288, 289, 290, 319, 320, 321, 308
See application file for complete search history.

(56) References Cited

U.S. PATENT DOCUMENTS

| | | | | |
|---|---|---|---|---|
| 2,482,317 | A * | 9/1949 | Borer | 368/288 |
| 3,362,154 | A * | 1/1968 | Perret | 368/290 |
| 3,453,819 | A * | 7/1969 | Simon | 368/290 |
| 5,257,247 | A * | 10/1993 | Miche et al. | 368/290 |
| 5,383,166 | A * | 1/1995 | Gallay | 368/288 |
| 6,872,899 | B2 * | 3/2005 | Oshio et al. | 200/43.13 |
| 7,357,569 | B2 * | 4/2008 | Yoshikawa | 368/308 |
| 2002/0167866 | A1 * | 11/2002 | Oomori et al. | 368/191 |
| 2004/0130971 | A1 | 7/2004 | Ecoffet et al. | |
| 2004/0257917 | A1 * | 12/2004 | Yoshikawa | 368/318 |
| 2005/0094498 | A1 * | 5/2005 | Koshoji et al. | 368/319 |

FOREIGN PATENT DOCUMENTS

EP 1205826 A1 5/2002

* cited by examiner

*Primary Examiner*—Vit W Miska
(74) *Attorney, Agent, or Firm*—Adams & Wilks

(57) ABSTRACT

A watch is offered in which the life of the threadedly engaged portion between the stem pipe and the crown can be improved and which has an internal thread capable of being machined relative to the crown easily and accurately. The watch is based on a watch in which the crown is threadedly locked to a stem pipe mounted to a barrel. The stem pipe has a barrel outside protruding portion provided with an external thread. The crown has a crown shaft and a crown ring having an internal thread removably threaded to the external thread, the ring being connected to the crown shaft. The crown shaft has a barrel insertion cylindrical portion which is smaller in diameter than the crown ring and inserted in the stem pipe and a ring connection portion mounted integrally with this cylindrical portion and connected to one end portion of the crown ring.

16 Claims, 3 Drawing Sheets

WATCH AND CROWN USED IN THIS WATCH

BACKGROUND OF THE INVENTION

1. Field of the Invention

The present invention relates to a watch equipped with a structure for holding the crown to prevent it from being inadvertently rotated and to a crown used in such a watch.

2. Description of the Prior Art

In some watches such as wristwatches, the crown is locked by making use of threaded engagement to prevent inadvertent rotation of the crown when carrying the watch (the structure or function is referred to as threadedly locking, threadedly locking structure, or threadedly locking function in the present specification).

In the threadedly locking structure, a stempipe is mounted to a barrel in which a watch movement is incorporated. The internal thread of the crown which is fitted over a barrel outside protruding portion is threadedly engaged to an external thread formed on the outer surface of the barrel outside protruding portion of this pipe. In this way, during normal times, the crown is threadedly engaged to the outer surface of the barrel outside protruding portion. Thus, threadedly locking is achieved, preventing inadvertent rotation of the crown. Also, when the watch movement is manipulated, the crown is threadedly disengaged from the external thread and then the crown is pulled and moved. Under this condition, the stem located inside the stem pipe can be rotationally manipulated via the crown.

The crown of the conventional watch equipped with such a threadedly locking structure consists of a single part. In particular, it is composed of an inner cylindrical body and an outer cylindrical body integral with it. The inner cylindrical body is a portion inserted into a stem pipe mounted to a barrel from outside of the barrel. The outer cylindrical body is shorter than the inner cylindrical body and covers an end part of this inner cylindrical body. An inner thread portion is formed in the inner surface of this outer cylindrical body. The crown is threadedly locked by bringing this inner thread into threaded engagement with an external thread formed on the outer surface of a barrel outside protruding portion of the stem pipe and bringing an end surface of the outer cylindrical body into abutment with a barrel outer surface (see, for example, Japanese Utility Model Application No. 7-26792).

The crown of the integrated structure described in Japanese Utility Model Application No. 7-26792 has a wall portion connecting its outer cylindrical body and inner cylindrical body integrally. This wall portion hinders insertion of a tapping tool beyond a certain extent when an internal thread is machined on the outer cylindrical body using the tapping tool such as a tap.

In this way, in threading machining for forming an internal thread on the outer cylindrical body of a crown, a care needs to be taken to prevent the tapping tool from striking the wall portion. Therefore, it is difficult to machine the crown. Consequently, this machining is disadvantageous in terms of cost.

Since the workability (machinability) of the threading machining is poor as described above, the accuracy at which internal threads are machined varies widely. As a result, there may occur a combination in which the accuracy of threaded engagement between the external thread of the stem pipe and the internal thread of the crown is low. In this case, as the crown is rotationally manipulated, the life of the threadedly engaging portion may be shortened.

Furthermore, because of the size of the crown that is a small part, 3 to 4 thread ridges can be formed at maximum on the internal thread formed on the outer cylindrical body. During manufacturing, the tapping tool makes the internal thread without passing through the outer cylindrical body. Therefore, those portions of this internal thread which are close to the wall portion are incompletely threaded portions. Consequently, as threadedly locking is done by bringing the external thread of the stem pipe and the internal thread of the crown into mesh each other, the incompletely threaded portions of the internal thread portion deform the external thread. This may lead to a decrease in the life of the threadedly engaging portion.

It is an object of the present invention to provide a watch which is capable of improving the life of the threadedly engaging portion between a stem pipe and a crown and which permits easy and accurate machining of an internal thread on the crown, as well as the crown used in this watch.

SUMMARY OF THE INVENTION

To solve the foregoing problem, a watch according to the present invention comprises a barrel; a stem pipe disposed outside the barrel and having a barrel outside protruding portion provided with an external thread, the stem pipe being mounted to the barrel; and a crown ring having a crown shaft and an internal thread removably threaded to the external thread. The crown shaft has a barrel insertion cylindrical portion inserted in the stem pipe and a ring connection portion mounted integrally with the cylindrical portion, the barrel insertion cylindrical portion being smaller in diameter than the crown ring. The ring connection portion is connected to an end portion of the crown ring.

In the present invention, the crown does not have an integrated structure consisting of a single part but has a structure having two parts, i.e., a crown ring and a crown shaft. Therefore, an internal thread for threadedly locking can be machined by passing a tapping tool through inside of the ring when the crown ring is in a single state. Consequently, threading machining can be performed easily. Concomitantly, the machining accuracy can be enhanced. In addition, the whole internal thread can be made a completely threaded portion. Accordingly, by using a crown fabricated by connecting the crown ring and the crown shaft passed through inside it, the accuracy of the threaded engagement between the internal thread of the crown and the external thread of the barrel outside protruding portion of the stem pipe can be enhanced. In addition, as the crown is rotationally manipulated, damage to the threadedly engaging portion between the internal thread of the crown and the external thread of the barrel outside protruding portion can be suppressed.

In a preferred embodiment of the watch of the present invention, the crown shaft and the crown ring are made of dissimilar materials.

In this preferred embodiment, the crown ring having the internal thread can be fabricated from a material adapted for threaded engagement such as a wear-resistant material without being restricted by the material of the crown shaft.

Furthermore, in a preferred embodiment of the watch of the present invention, the crown ring and the crown shaft are made different in color.

In this preferred embodiment, various color variations are adapted to be given to the crown according to the design required for the crown, instead of a single color tone.

In this case, the crown ring and the crown shaft may be made of dissimilar materials having different color tones. Alternatively, if they are made of the same material, a color layer formed by surface treatment such as plating may be formed on at least one of them and practiced. Where the color layer is formed by plating, the corresponding crown ring or the like may be plated with a metal while it is in a single state. At this time, it is not necessary to mask the other crown shaft. Consequently, the color layer can be formed easily.

In addition, in a preferred embodiment of the watch of the present invention, the crown ring is provided with a coupling hole having a diameter larger than that of the internal thread. The ring connection portion has a connecting internal thread portion threaded into a part of the external thread and a press-fitted portion press fitted in the coupling hole by threaded engagement between the connection external thread portion and the internal thread.

In this preferred embodiment, the crown shaft and the crown ring can be connected by bringing the connecting external thread portion of the crown shaft into mesh with a part of the internal thread of the crown ring. In addition, because of the threaded engagement, the press-fitted portion of the crown shaft is pulled into the coupling hole in the crown ring and press fitted into this coupling hole. Therefore, the crown shaft and the crown ring can be connected even in this engaging portion. Consequently, the crown shaft and the crown ring are connected more reliably. As the crown is manipulated, the danger that the threadedly engaged portion between the crown shaft and the crown ring loosens can be eliminated.

In addition, to solve the foregoing problem, a crown for a watch of the present invention comprises a crown shaft and a crown ring having an internal thread in its inner surface. The crown shaft has a barrel insertion cylindrical portion of a diameter smaller than that of the crown ring and a ring connection portion mounted integrally with this cylindrical portion and connected to an end portion of the crown ring.

The crown of the present invention consists of two parts, i.e., a crown ring and a crown shaft, instead of a single part. An internal thread for threadedly locking can be machined by passing a tapping tool through inside of this ring when the crown ring is in a single state. In consequence, threading machining can be simply performed. Concomitantly, the machining accuracy can be enhanced. In addition, the whole internal thread can be made a completely threaded portion. Accordingly, the crown fabricated by connecting this crown ring and the crown shaft passed through inside thereof is used as a crown for threadedly locking in a watch. This can enhance the accuracy of threaded engagement between the internal thread of this crown and the external thread of the barrel outside protruding portion of the stem pipe. As the crown is rotationally manipulated, damage to the threadedly engaged portion between the internal thread of the crown and the external thread of the barrel outside protruding portion can be suppressed.

BRIEF DESCRIPTION OF THE SEVERAL VIEWS OF THE DRAWINGS

A preferred form of the present invention is illustrated in the accompanying drawings in which.

DETAILED DESCRIPTION OF THE PREFERRED EMBODIMENTS

One embodiment of the present invention is described by referring to FIGS. 1-5.

Figure 1:
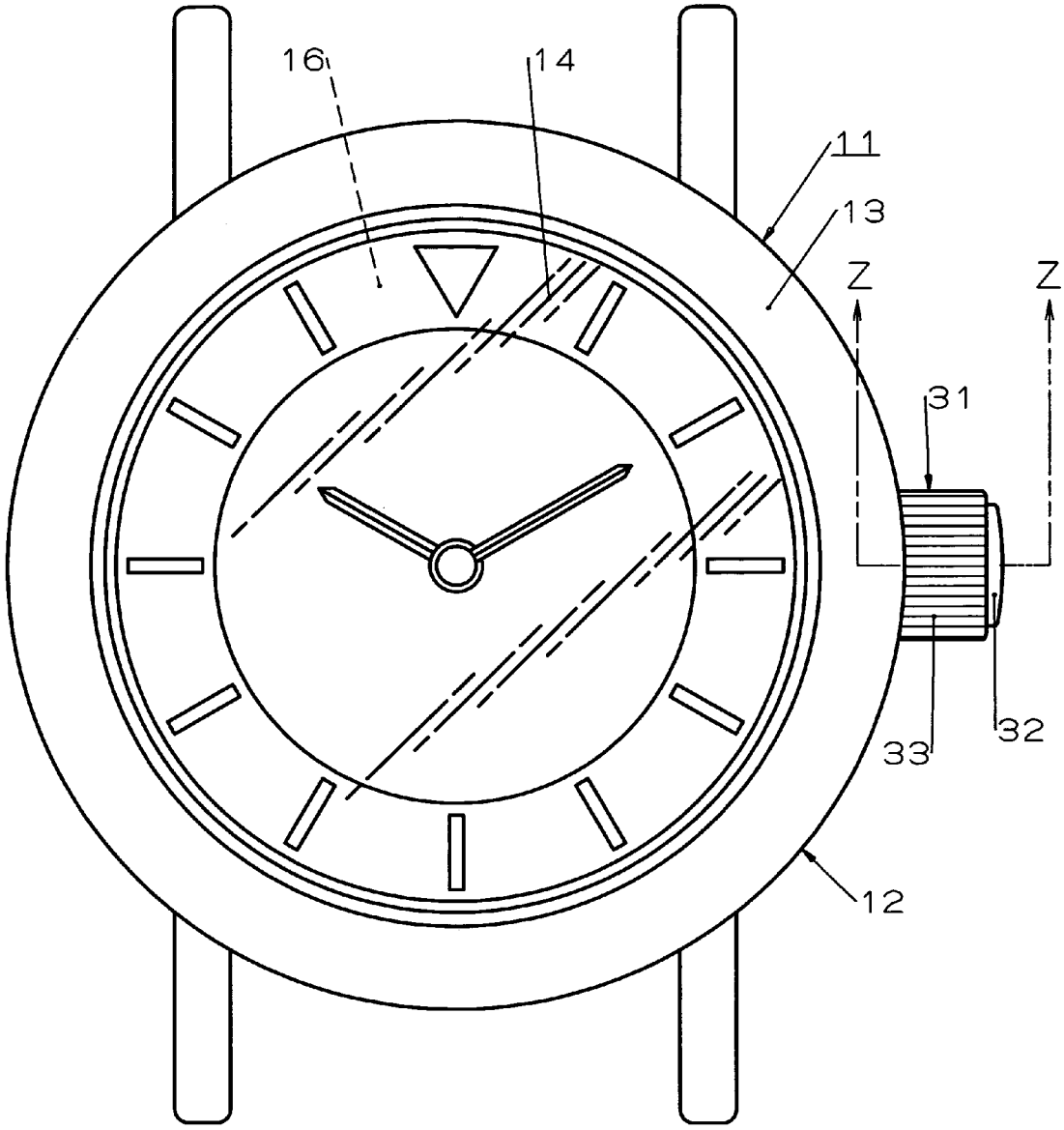
FIG. 1 is a front elevation showing a wristwatch associated with one embodiment of the present invention.

In FIG. 1, symbol 11 indicates a watch equipped with a function of threadedly locking the crown such as a wristwatch. The wristwatch 11 incorporates a watch movement (not shown) or the like in a watch outer assembly 12. The watch movement may be any one of a movement powered by a small-sized battery or spring, an automatically wound movement, a movement corresponding to a digital watch that uses a quartz oscillation module and digitally displays the time and so forth on a dial, and a combination of a movement corresponding to a digital watch with others.

The watch outer assembly 12 has a watch case in the form of an annular barrel 13 made of a metal, such as stainless steel or titanium, or synthetic resin. A cover glass 14 is mounted to the whole surface of the barrel in the direction of thickness in a liquidtight manner. A rear cover 15 (see FIGS. 2 and 3) made of a metal or the like is mounted to the rear surface of the barrel 13 in the direction of thickness in a liquidtight manner. It is possible to see through the dial 16 and so on via the cover glass 14. The rear cover 15 can be removed.

Figure 2:
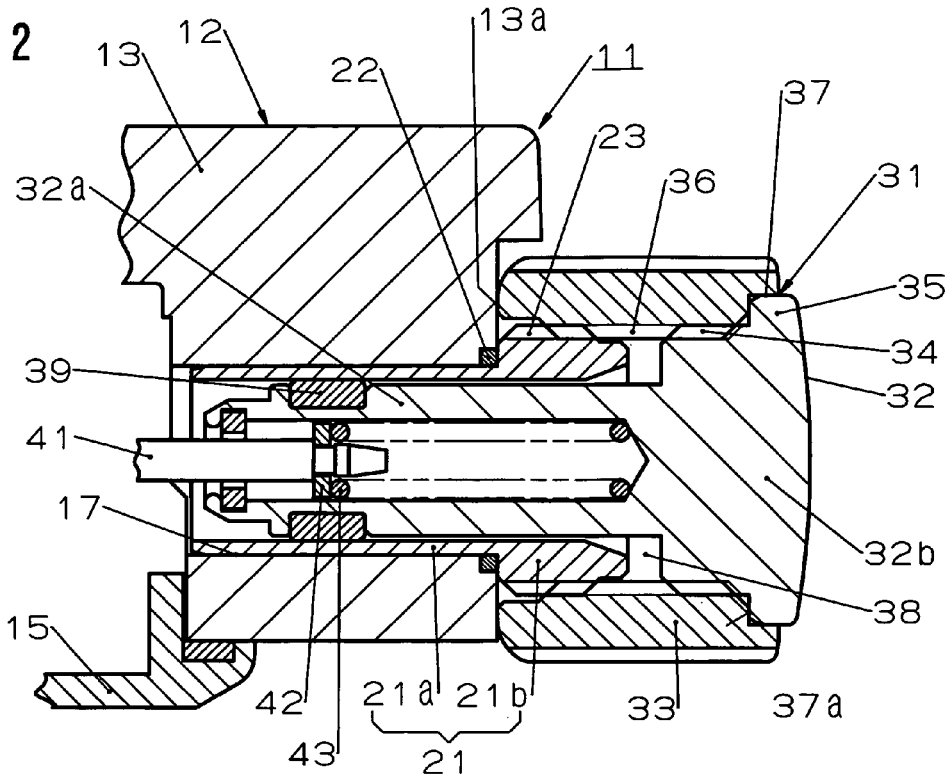
FIG. 2 is a cross-sectional view shown along the line Z-Z through FIG. 1 in a state in which the crown has been threadedly locked.
Figure 3:
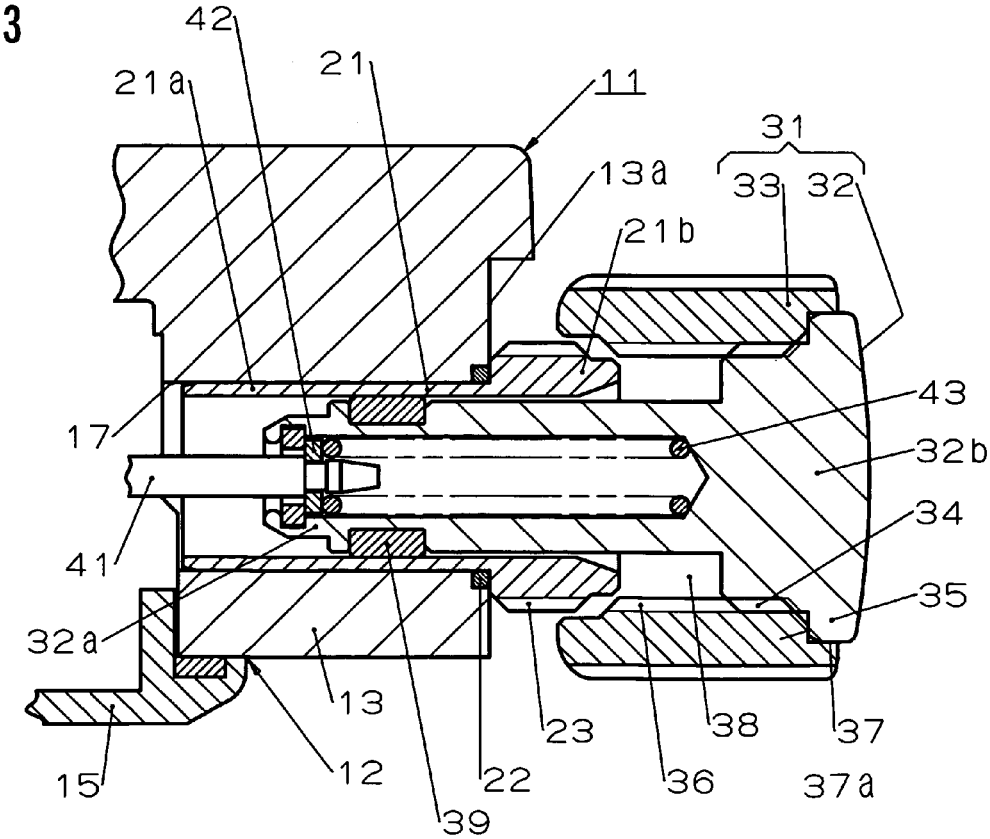
FIG. 3 is a cross-sectional view shown along the line Z-Z through FIG. 1 in a state in which the crown has been threadedly unlocked.

As shown in FIGS. 2 and 3, a pipe installation hole 17 extending radially through the barrel 13 is formed in a part of the barrel 13. One end of the pipe installation hole 17 opens into the barrel, i.e., into the inside of the watch outer assembly 12. The other end of the pipe installation hole 17 opens to the outside of the barrel, i.e., outside of the watch outer assembly 12.

A stem pipe 21 inserted into the pipe installation hole 17 from outside of the barrel is fixed to the barrel 13 in a liquidtight manner. A metal such as stainless steel can be preferably used as the stem pipe 21. The stem pipe 21 has an insertion portion 21*a* at one end side and a barrel outside protruding portion 21*b* at the other end side. The insertion portion 21*a* is inserted and fixed in the pipe installation hole 17 from outside of the barrel. In the present embodiment, the insertion portion 21*a* is inseparably fixed to the barrel 13 using a metallic brazing material 22. The brazing material 22 assuming the function of the fixing also acts as a member for maintaining the liquidtightness to provide waterproofness between the barrel 13 and the stem pipe 21.

Instead of this, the insertion portion may be fixed in a watertight manner by forming an internal thread in the pipe installation hole 17, forming an external thread upon the insertion portion, bringing these threaded portions into mesh with each other, and providing waterproof packing at a position where the brazing material is applied. Furthermore, the stem pipe 21 can also be fixed to the barrel 13 by other fixing means. The insertion portion 21*a* may have a length sufficient to extend through the pipe installation hole 17.

The barrel outside protruding portion 21*b* is a portion located outside the barrel 13 and is larger in diameter than the insertion portion 21*a*. An external thread 23 is formed on the outer surface of the barrel outside protruding portion 21*b*. The end surface of the barrel outside protruding portion 21*b* on the insertion portion side is in abutment with a barrel outer surface 13*a*.

A crown indicated by symbol 31 in FIGS. 1 to 5 is fabricated by connecting a crown shaft 32 and a crown ring 33. The crown shaft 32 and the crown ring 33 are made of similar or dissimilar metal materials. Examples of the used metals include stainless steel and titanium. Of the crown shaft. 32 and the crown ring 33, at least the crown ring 33 has a color layer formed by surface treatment such as metal plating treatment and can be made different in color from the barrel 13 or crown shaft 32.

Figure 4:
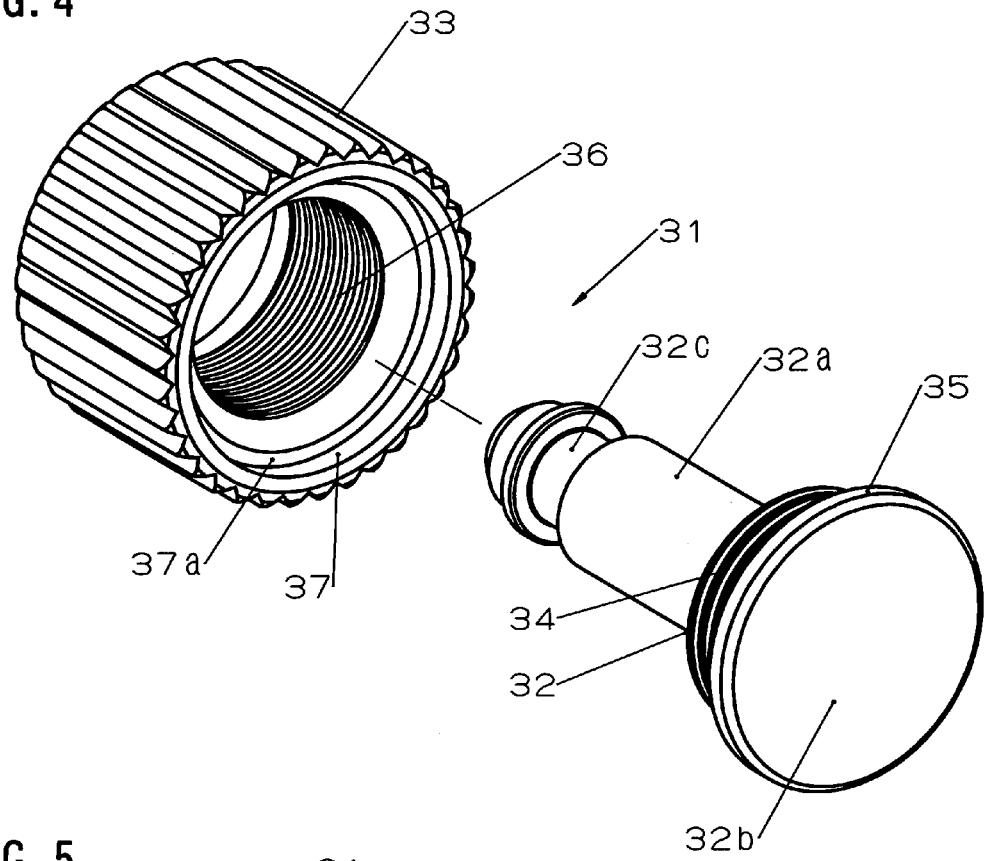
FIG. 4 is an exploded perspective view of the crown of a wristwatch associated with one embodiment.
Figure 5:
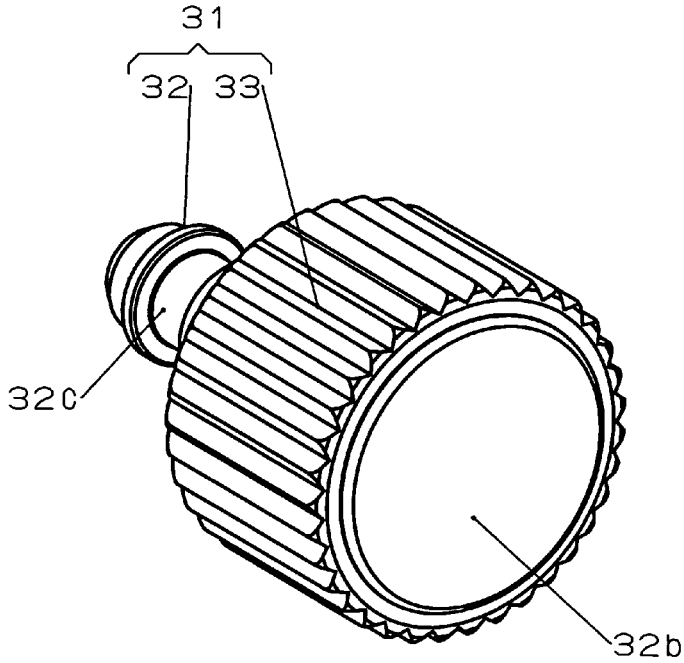
FIG. 5 is a perspective view showing the crown of a wristwatch associated with one embodiment.

As shown in FIGS. 2-4, the crown shaft 32 has a barrel insertion cylindrical portion 32*a* and a ring connection portion 32*b*. The diameter of the barrel insertion cylindrical portion 32*a* is smaller than the inside diameter of the crown ring 33. Its one end in the axial direction is open. The ring connection portion 32*b* is larger in diameter than the barrel insertion cylindrical portion 32*a* but smaller than the outside diameter of the crown ring 33. This ring connection portion 32*b* is mounted integrally with the other end of the barrel insertion cylindrical portion 32*a* in the axial direction.

The ring connection portion 32*b* has a connection threaded portion 34 in the form of external thread and a press-fitted portion 35 on its outer surface. This ring connection portion 32*b*functions as a closing end portion for closing off one end portion of the crown ring 33. The connection threaded portion 34 is totally made of a completely threaded portion. This connection threaded portion 34 is mounted in a position closer to the barrel insertion cylindrical portion 32*a* than the press-fitted portion 35. The press-fitted portion 35 is mounted in a position further from the barrel insertion cylindrical portion 32*a* than the connection threaded portion 34. The press-fitted portion 35 is larger in diameter than the connection external threaded portion 34, is circular as shown in FIG. 4, and forms a maximum diametrical portion of the ring connection portion 32*b*.

The crown ring 33 is shorter in length than the crown shaft 32. An internal thread 36 for threadedly locking is formed on the inner surface of the crown ring 33. A coupling hole 37 larger in diameter than the inside diameter of the crown ring 33 is formed in the crown ring 33. As shown in FIG. 4, the coupling hole 37 is in the form of an annular groove and has a deep surface 37*a* continuous with one end of the internal thread 36 and is open to one end of the crown ring 33. Unevenness is formed on the outer surface of the crown ring 33 to prevent the user's finger from slipping when the crown is manipulated.

The crown shaft 32 and the crown ring 33 are connected by passing the crown shaft 32 through inside of the crown ring 33, bringing the connection threaded portion 34 into mesh with one end portion of the internal thread 36 to thereby pull the press-fitted portion 35 into the coupling hole 37, and press fitting the press-fitted portion into the hole. In this manner, the crown ring 33 is positioned circumferentially around and connected to the outer end portion of the crown shaft 32.

In this assembly, the threaded engagement between the connection threaded portion 34 and the internal thread 36 and the engagement between the press-fitted portion 35 and the coupling hole 37 ensure the connection between the crown shaft 32 and the crown ring 33, thus assembling the crown 31. Therefore, it is possible to eliminate the danger that the threadedly engaged portion between the crown shaft 32 and the crown ring 33 is loosened as the crown is manipulated as described later.

For further prevention of loosening, adhesive is permitted to be supplementarily entered between the press-fitted portion 35 and the coupling hole 37 to fix them together. Furthermore, in the present invention, in a case where the crown shaft 32 and the crown ring 33 are made of the same metal, the connection threaded portion 34 of the crown shaft 32 may be omitted, and the engaging portions of the press-fitted portion 35 and the coupling hole 37 may be welded together. Where the crown shaft 32 and the crown ring 33 are made of the same metal, the connection threaded portion 34 of the crown shaft 32 may be omitted, and the engaging portions of the press-fitted portion 35 and the coupling hole 37 may be fixed together with adhesive.

As described so far, the crown 31 is not a single part but is fabricated by connecting two parts, or the crown shaft 32 and the crown ring 33. Therefore, the internal thread 36 for threadedly locking can be machined by inserting a tapping tool (not shown) such as a tap into the inner surface of the crown ring 33 when the crown ring 33 is in a single state.

In this case, the tapping tool can be passed through the crown ring 33 in the axial direction. Accordingly, it is not necessary to take care to subtly control the insertion depth of the tapping tool. Therefore, the machinability with which the internal thread 36 is formed on the crown 31 is improved. In consequence, the internal thread 36 can be machined at low cost. Furthermore, as the machinability is improved in this way, dimensional variations of the internal thread 36 are suppressed, and the machining accuracy can be improved. In addition, a tapping tool is passed through the crown ring 33 during the manufacturing process as described previously to machine the internal thread 36. Consequently, the internal thread 36 free of incompletely threaded portions, i.e., the internal thread 36 formed from completely threaded portions from the beginning to the end of the threading, can be machined.

The crown 31 assembled as shown in FIGS. 2 and 3 is provided with an annular groove 38 permitting insertion of the barrel outside protruding portion 21*b* between the crown ring 33 and the inside crown shaft 32. The crown shaft 32 of this crown 31 is inserted inside the stem pipe 21 such that the shaft is movable back and forth in the axial direction. Annular waterproof packing 39 made of a resilient material having resilience such as rubber is mounted in an annular packing installation groove 32*c* (see FIGS. 4 and 5) formed in the outer surface of the crown shaft 32. The waterproof packing 39 is resiliently deformed into a compressed state between the inner surface of the stem pipe 21 and the outer surface of the crown shaft 32, thus providing waterproofness between them.

The internal thread 36 of the crown 31 is removably threaded to the external thread 23 of the stem pipe 21. In this case, the internal thread 36 can be more threaded into the external thread 23 by putting a finger on the crown ring 33 of the crown 31 and rotating the crown 31 in the direction to tighten it. Conversely, the threaded engagement can be released by rotating the crown 31 in the direction to loosen it as shown in FIG. 3. The end surface of the crown ring 33 is brought into abutment with the barrel outer surface 13*a* of the barrel 13 as shown in FIG. 2 by rotating the crown 31 to tighten it. Thus, the threadedly locking function is exhibited to prevent inadvertent rotation of the crown 31 during carriage of the wristwatch 11.

As shown in FIGS. 2 and 3, a watch stem 41 of the watch movement is slidably inserted in the barrel insertion cylindrical portion 32*a* from inside of the barrel 13 toward the outside, i.e., the watch stem 41 is slidably attached to an inner end portion of the crown shaft 32. A biasing body such as a coil spring 43 for biasing the crown 31 outwardly of the barrel 13 via a spring receiver 42 while supported by the stem 41 is also accommodated. The watch movement is rotated interlockingly with rotational manipulations of the crown 31 under the condition where the internal thread 36 has been disengaged from the external thread 23 (in other words, the threadedly locking has been released (see FIG. 3)) . Consequently, the watch time function can be set.

After manipulation of the crown, the crown 31 is mounted to the barrel outside protruding portion 21*b* and threadedly locked. For this purpose, the internal thread 36 of the crown ring 33 is threaded into the external thread 23 of the barrel outside protruding portion 21*b* while being pushed into the stem pipe 21 from outside of the barrel 13 while the stem 41 is kept connected with the crown shaft 32, and then the internal thread is tightened. The crown ring 33 is abutted against the barrel outer surface 13*a* under the condition where the crown 31 has been most deeply threaded into the external thread 23. The crown 31 covers and hides the barrel outside protruding portion 21*b*.

When this wristwatch 11 is being carried, the crown 31 is threadedly locked. Therefore, the displayed time can be prevented from varying due to inadvertent rotation of the crown 31. When the watch is set, the crown 31 is rotated in the direction opposite to the direction used when threadedly locking is done, disengaging the internal thread 36 from the external thread 23. The crown 31 is pulled out against the spring force of the coil spring 43. Under this condition, the setting of the time function can be done.

Decrease in the life of the threadedly engaged portion between the internal thread 36 of the crown 31 and the external thread 23 of the stem pipe 21 as the crown is manipulated as described so far can be suppressed for the following reasons.

First, as the accuracy at which the internal thread 36 of the crown 31 is machined is improved as described previously, the accuracy at which the internal thread 36 and the external thread 23 of the stem pipe 21 mesh with each other is improved. Therefore, the smoothness of the threaded engagement between the external thread 23 and the internal thread 36 is assured. Damage to the threadedly engaged portion due to defect in the threaded engagement is suppressed. As a result, decrease in the life of the threadedly engaged portion can be suppressed.

Secondly, the internal thread 36 of the whole crown 31 is totally made of a completely threaded portion and does not have any incompletely threaded portion as described above. Therefore, as the crown 31 is rotationally manipulated, it is unlikely that the external thread 23 of the stempipe 21 is deformed by an incompletely threaded portion. Hence, decrease in the life of the threadedly engaged portion can be suppressed.

Furthermore, the crown ring 33 of the above-described structure forms an outer cylindrical portion of the crown 31. Since the dimension of the wall thickness between the inner surface consisting of the internal thread 36 of this outer cylindrical portion and the outer surface consisting of an uneven surface can secure a minimum thickness dimension necessary for the crown 31, the outer diameter of the crown 31 is prevented from increasing with desirable results. Incidentally, a structure is conceivable in which the outer cylindrical portion of the crown is composed of an outer cylindrical portion integral with a crown shaft and an outer cylindrical ring fixed to the inner surface of this portion using an adhesive, and in which an internal thread is machined in the inner surface of this ring. With this structure, however, this outer cylindrical portion needs some extent of thickness to secure mechanical strength for the outer cylindrical portion. In addition, the thickness of the outer cylindrical ring having some degree of thickness permitting machining of the internal thread and the thickness of the adhesive layer are added to this outer cylindrical portion. Therefore, the wall thickness of the outer cylindrical portion of this crown is urged to be increased. This increases the outer diameter of this crown.

The present invention is not limited to the above-described one embodiment. The invention can also be applied to wristwatches required to have high-pressure waterproof performance such as divers watches. In addition, the invention can also be applied to watches not required to have such high-pressure waterproof performance such as normal wristwatches, pocket watches, and necklace hanging watches.

According to the present invention, a watch can be provided which is capable of improving the life of the threadedly engaging portion between a stem pipe and a crown and which permits easy and accurate machining of an internal thread on the crown, as well as the crown used in this watch.

What is claimed is:

1. A watch comprising:

a barrel;

a stem pipe disposed outside said barrel and having a barrel outside protruding portion provided with an external thread; and a crown having a crown shaft and a crown ring connected to said crown shaft, the crown ring having an internal thread removably threaded to said external thread, said crown shaft having a barrel insertion cylindrical portion inserted in said stem pipe and a ring connection portion integral with the cylindrical portion, the ring connection portion being threadedly connected to said internal thread at one end portion of said crown ring, the barrel insertion cylindrical portion being smaller in diameter than said crown ring.

2. A watch according to claim 1, wherein said crown shaft and said crown ring are made of dissimilar materials.

3. A watch according to claim 1, wherein said crown ring and said crown shaft are made different in color.

4. A watch according to claim 1, wherein said crown ring is provided with a coupling hole that is larger in diameter than said internal thread, and wherein said ring connection portion has a connecting external threaded portion threaded into a part of said internal thread and a press-fitted portion press fitted in said coupling hole by threaded engagement between the connecting external threaded portion and said internal thread.

5. A watch according to claim 1; wherein said ring connection portion has an external threaded portion threaded into a part of said internal thread.

6. A crown for a watch, comprising:

a crown shaft; and a crown ring having an internal thread in its inner surface for threaded connection to a stem pipe of a watch;

said crown shaft having a barrel insertion cylindrical portion of a diameter smaller than that of said crown ring and a ring connection portion integral with said barrel insertion cylindrical portion and threadedly connected to the internal thread of said crown ring.

7. A crown for a watch according to claim 6, wherein said crown ring is provided with a coupling hole that is larger in diameter than said internal thread, and wherein said ring connection portion has a connecting external threaded portion threaded into a part of said internal thread and a press-fitted portion press fitted in said coupling hole by threaded engagement between the connecting external threaded portion and said internal thread.

8. A watch comprising:

a watch case having a pipe installation hole extending therethrough;

a stem pipe having an insertion portion inserted into the pipe installation hole and fixed to the watch case and a protruding portion connected to the insertion portion and protruding outside the watch case, the protruding portion having an external thread; and a crown comprised of a crown shaft and a crown ring, the crown shaft being axially displaceable and rotatable in the insertion portion of the stem pipe and having an inner end portion slidably attached to a watch stem and an outer end portion disposed outside the watch case, and the crown ring being disposed circumferentially around and threadedly connected to the outer end portion of the crown shaft and having an internal thread threadedly engageable with the external thread of the stem pipe protruding portion in response to rotation of the crown ring in one direction to axially displace the crown ring inwardly into abutment with the watch case thereby locking the crown against inadvertent rotation and disengageable from the external thread in response to rotation of the crown ring in the opposite direction to permit the crown to be pulled outwardly and rotated to change a function of the watch.

9. A watch according to claim 8; wherein the crown shaft and the crown ring are made of different materials.

10. A watch according to claim 8; wherein the crown shaft and the crown ring are different in color from one another.

11. A watch according to claim 8; wherein the crown ring has an annular groove at an outer end portion thereof, and the crown shaft has a connection portion at the outer end portion thereof, the connection portion being press-fitted in the annular groove.

12. A watch according to claim 11; wherein the crown shaft has an external thread threadedly engaged with the internal thread of the crown ring.

13. A watch according to claim 8; wherein the crown shaft has an external thread threadedly engaged with the internal thread of the crown ring.

14. A watch according to claim 13; wherein the crown shaft and the crown ring are made of different materials.

15. A watch according to claim 13; wherein the crown shaft and the crown ring are different in color from one another.

16. A watch according to claim 8; wherein the outer end portion of the crown shaft has an external thread threaded into a part of the internal thread of the crown ring.

* * * * *

UNITED STATES PATENT AND TRADEMARK OFFICE

CERTIFICATE OF CORRECTION

PATENT NO. : 7,591,582 B2
APPLICATION NO. : 11/353469
DATED : September 22, 2009
INVENTOR(S) : Hiranuma et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 518 days.

Signed and Sealed this

Twenty-first Day of September, 2010

David J. Kappos

David J. Kappos
*Director of the United States Patent and Trademark Office*